US006513539B2

(12) United States Patent
Tanaka

(10) Patent No.: US 6,513,539 B2
(45) Date of Patent: Feb. 4, 2003

(54) SUBMERGED CONVEYANCE STRUCTURE FOR PHOTOSENSITIVE MATERIAL

(75) Inventor: Katsuhiko Tanaka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/864,178

(22) Filed: May 25, 2001

(65) Prior Publication Data

US 2001/0045225 A1 Nov. 29, 2001

(30) Foreign Application Priority Data

May 29, 2000 (JP) ..... 2000-158378
Apr. 26, 2001 (JP) ..... 2001-129790

(51) Int. Cl.[7] ..... B08B 3/04

(52) U.S. Cl. ..... 134/64 P; 134/64 R; 134/122 R; 134/122 P; 134/73; 134/68

(58) Field of Search ..... 134/122 R, 64 R, 134/184, 186, 73, 61, 68, 66, 122 P, 64 P

(56) References Cited

U.S. PATENT DOCUMENTS 4,282,825 A * 8/1981 Nagatmon et al.
4,557,785 A * 12/1985 Ohkuma
4,722,355 A * 2/1988 Moe
5,366,156 A * 11/1994 Bauer et al.
5,779,796 A * 7/1998 Tomoeda et al.
5,950,327 A * 9/1999 Peterson et al.
5,954,888 A * 9/1999 Gupta et al.

FOREIGN PATENT DOCUMENTS

JP 1-106493 * 5/1989
JP 4-357842 * 12/1992

OTHER PUBLICATIONS

Masatake Katagiri; Nippon Polyurethane Industry Co., Ltd. Technical Research Institute "Latest Polyurethan Application Technology CMC", Feb. 26, 1983; pp. 116–117.

* cited by examiner

*Primary Examiner*—Frankie L. Stinson
(74) *Attorney, Agent, or Firm*—Sughrue Mion, PLLC

(57) ABSTRACT

A submerged conveyance structure for a photosensitive material, including a main body, a blade, and a blade press. The blade covers the slit hole in the state with the portions other than the portion contacting the photosensitive material, that is, the vicinity of the end edges of both sides in the longitudinal direction and the vicinity of the end edge on the opposite side with respect to the side elastically contacting the conveyance path upper wall surface, nipped by the blade press and the first tilted surface having the slit hole. Thus, the sealing property can further be made certain at the portions other than the portion that contacts the photosensitive material.

20 Claims, 5 Drawing Sheets

SUBMERGED CONVEYANCE STRUCTURE FOR PHOTOSENSITIVE MATERIAL

BACKGROUND OF THE INVENTION

1. Field of the Invention

The present invention relates to a submerged conveyance structure for photosensitive material. More specifically, it relates to a submerged conveyance structure for photosensitive material, the structure being applied to a photosensitive material processing device for executing predetermined processing by processing solutions stored in processing tanks, by conveying a photosensitive material to adjacent processing tanks via a path with a blade provided in a partition wall between the processing tanks.

2. Description of the Related Art

In an automatic developing device (such as a film processor, and a printer processor) used in a laboratory, a photosensitive material (such as film and color paper) is processed.

The film and the color paper are processed by being successively conveyed through processing tanks housing water or processing solutions for color development, bleaching fixation, washing with water, and stabilization.

The solution component composition and amount of the processing solution in each tank varies depending on the processing of the film or the color paper.

Therefore, new solution or water is replenished to each processing tank from a replenishing tank according to the amount of film or color paper processed so as to maintain the solution component composition and amount of the water or solution.

Recently, submerged conveyance by a process in which a washing tank is partitioned by a submerged seal such as a roller or a blade has been proposed for water washing tanks and such.

Conventional water washing tanks have a structure in which a photosensitive material is conveyed in the air once (so-called crossover) when the material is conveyed from a previous water washing tank to a next water washing tank. However, in submerged conveyance, by using a partition such as a roller or a blade in the crossover, the distance by which the material is conveyed is shortened so as to reduce processing time.

However, there has been the problem that, in such a submerged conveyance system, if there is a gap at the roller or the blade in the partition portion, solution is leaked from the previous bath to the next bath, whereby the solution concentration of the latter rises and water washing ability becomes poor.

Therefore, sealability between tanks drastically influences water washing ability in the submerged conveyance structure. In order to maintain water washing efficiency, it is necessary to increase the amount by which the washing water is replenished. Of course, it can be-expected that increasing the replenishing amount results in an increase of solution that is wasted.

Furthermore, even in tanks other than the water washing tanks, processing solution performance is reduced by solutions in respectively adjacent tanks becoming mixed.

Therefore, in order to maintain high performance and reduce the amount by which the solutions must be replenished, there has been a demand for a sealing method with little leakage amount.

However, the blade is a part that is movably deformed when the photosensitive material is conveyed, and it is thus extremely difficult to maintain the sealing property.

SUMMARY OF THE INVENTION

In consideration of the above-mentioned circumstances, an object of the present invention is to provide a submerged conveyance structure for photosensitive material, with the structure being capable of reliably preventing, with a small number of parts, leakage of solutions among processing tanks.

A submerged conveyance structure for photosensitive material pertaining to a first aspect of the present invention has a main body, the main body including a photosensitive material conveyance path for passage of a photosensitive material, the photosensitive material conveyance path formed in partition walls between processing tanks in which processing solutions are stored; a sheet-like blade, the blade disposed in the photosensitive material conveyance path and having an elasticity capable of allowing passage of the photosensitive material with respect to the photosensitive material conveyance path while preventing passage of the processing solutions; and a mounting member for mounting the blade to the photosensitive material conveyance path; wherein the photosensitive material conveyance path has a first tilted surface provided at the upstream side of the direction in which the photosensitive material is conveyed, the first tilted surface facing one surface of the photosensitive material and tilted by an acute angle toward the upstream side of the direction in which the photosensitive material is conveyed, with respect to a photosensitive material passage route, a second tilted surface provided at the upstream side of the direction in which the photosensitive material is conveyed, the second tilted surface facing the other surface of the photosensitive material and tilted by an acute angle toward the upstream side of the direction in which the photosensitive material is conveyed, with respect to the photosensitive material passage route, and a slit hole provided at the downstream side of the direction in which the photosensitive material is conveyed, the slit hole opening toward one of the first tilted surface and the second tilted surface, the slit hole being formed lengthwise in a direction orthogonal to the direction in which the photosensitive material is conveyed, and the blade covers the slit hole in a state in which an end edge extending in the longitudinal direction at the side facing the slit hole elastically contacts one of a path upper wall surface and a path lower wall surface of the photosensitive material conveyance path, and a vicinity of the end edges of both sides in the longitudinal direction and a vicinity of the end edge on the opposite side with respect to the side elastically contacting either one of the path upper wall surface and the path lower wall surface are nipped by the mounting member and at least one of the first tilted surface or the second tilted surface having the slit hole.

Photosensitive material processed by processing solutions in processing tanks is conveyed by a conveyance device such as a roller to be sent to an adjacent next processing tank via a photosensitive material conveyance path for successive predetermined processing.

Here, when the photosensitive material passes through the photosensitive material conveyance path, since the photosensitive material is conveyed between the blade and the path upper wall surface or the path lower wall surface while being slid against both, adjacent solutions cannot be mixed with each other. Moreover, when the rear end of the photosensitive material (with respect to the direction in which the photosensitive material is conveyed) passes along the photosensitive material conveyance path, the blade elastically contacts the path upper wall surface or the path lower wall surface to therefore prevent mixing of the adjacent solutions with each other.

Moreover, since the blade covers the slit hole in the state with the portions other than the portion contacting the photosensitive material (i.e., the vicinity of the end edges of both sides in the longitudinal direction and the vicinity of the end edge on the opposite side with respect to the side elastically contacting either one of the path upper wall surface and the path lower wall surface) nipped by the mounting member and at least one of the first tilted surface and the second tilted surface having the slit hole, the sealing property can further be made certain at the portions other than the portion that contacts the photosensitive material.

The submerged conveyance structure for a photosensitive material according to the present invention, the first tilted surface and the second tilted surface are preferably tilted with respect to the photosensitive material passage route in a range of 10° to 80°. Further, one of the first tilted surface and the second tilted surface preferably includes screw holes and projections along the longitudinal direction. Furthermore, the blade preferably includes circular or elongated holes at a position corresponding to the screw holes and the projections.

It is further preferable that the mounting member includes a screw hole and a fitting hole at positions corresponding to each of the screw holes and the projections.

Furthermore, it is preferable that the main body, the blade part and the mounting part are detachable. Moreover, preferably, a mounting surface nearest the photosensitive material conveyance path and opposite to a blade nipping surface of the mounting member is a conveyance surface.

Since the submerged conveyance structure for photosensitive material, which structure allows passage of the photosensitive material and prevents mixture of adjacent solutions, comprises three parts, i.e., the main body having the photosensitive material conveyance path, the blade, and the mounting member for mounting the blade, the number of parts structuring the conveyance structure can be reduced and assembly can be facilitated. Moreover, since the blade can be replaced by removing the photosensitive material path member to the outside of the tank, replacement of the blade is facilitated The submerged conveyance structure for photosensitive member according to the present invention, longitudinal direction side portions of the end edge of the blade, which end edge elastically contacts the path wall surface, are preferably inserted in a groove formed at an area where the first tilted surface and the second tilted surface intersect. Further preferably, the groove includes a width greater than blade thickness. Furthermore, the blade preferably comprises a substantially rectangular shape with a fixed thickness and the blade thickness is in a range of 0.3 to 0.7 mm.

Since both end edge portions of the blade extending in the longitudinal direction elastically contacting the path upper wall surface or the path lower wall surface are inserted and held in the groove formed at the intersection portion of the first tilted surface or the second tilted surface at both sides of the slit hole in the longitudinal direction, the sealing property at the blade longitudinal direction both end parts can further be made certain.

The submerged conveyance structure for photosensitive material according to the present invention, the blade is preferably held relatively movably between the main body and the mounting member. It is further preferable that a dimension of the mounting member in the longitudinal direction is set to be substantially the same as a dimension of the blade in the longitudinal direction. Furthermore preferably, the dimension of the first tilted surface in the longitudinal direction and the dimension of the second tilted surface in the longitudinal direction are greater than the dimension of the slit hole in the longitudinal direction and the dimension of the first tilted surface in the longitudinal direction and the dimension of the second tilted surface in the longitudinal direction are greater than the it dimension of the blade in the longitudinal direction.

Since the blade is reciprocally movable between the main body and the mounting part, generation of distortion (waves, wrinkles or the like) of the blade can be restrained in the case the difference is generated between the blade stretch amount and the main body and mounting part stretch amount is generated at the time of thermal expansion.

The submerged conveyance structure for photosensitive material according to the present invention, the main body and the mounting member preferably comprise a synthetic resin including glass fiber.

Since the main body and the mounting part are made of a synthetic resin containing a glass fiber, the coefficient of linear expansion can be reduced compared with one made of a synthetic resin not containing a glass fiber conventionally used commonly, and thus the cause of generating distortion can be reduced.

The submerged conveyance structure for a photosensitive material according to the present invention, areas of the main body and the mounting member contacting the photosensitive material are preferably disposed with a low frictional material having a friction coefficient lower than that of the material comprising the main body and the mounting member.

Since a low frictional material is provided in the main body and the mounting part at the portion in contact with the photosensitive material, process of wearing of the portion in contact with the photosensitive material can be delayed so that the sealing property can be maintained over a long time. Moreover, the photosensitive material can be conveyed while being slid smoothly.

DESCRIPTION OF THE PREFERRED EMBODIMENTS

Hereinafter, an embodiment of the present invention will be described.

Figure 2:
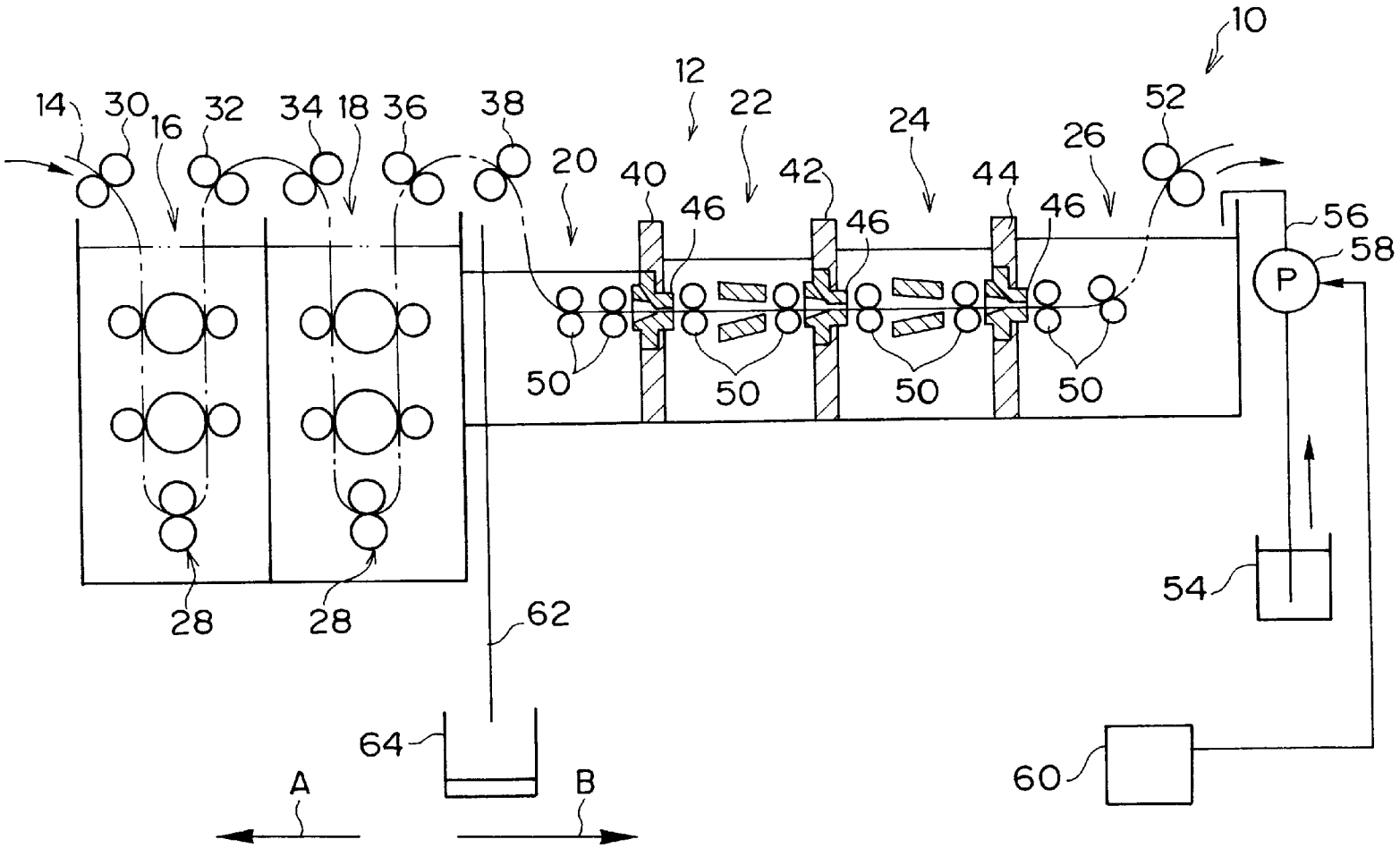
FIG. 2 is a schematic diagram of an automatic developing device to which the present invention has been applied.

FIG. 2 shows a development processing section 12 of an automatic developing device 10.

In the development processing section 12, a developing tank 16, a fixation bleaching tank 18, a first water washing tank 20, a second water washing tank 22, a third water washing tank 24 and a fourth water washing tank 26 are horizontally disposed in sequence from the upstream side of the direction in which the photosensitive material 14 is conveyed (i.e., the direction indicated by arrow A; hereinafter, the "upstream side").

A predetermined amount of developing solution is stored in the developing tank 16, and a predetermined amount of fixation bleaching solution is stored in the fixation bleaching tank 18.

Moreover, a predetermined amount of washing water is respectively stored as a processing solution in the first water washing tank 20, the second water washing tank 22, the third water washing tank 24 and the fourth water washing tank 26.

The photosensitive material 14 of the present embodiment is a silver halide photosensitive material (paper) for photography.

A conveyance device 28 comprising a plurality of rollers is provided in the developing tank 16 and in the fixation bleaching tank 18 for conveying the photosensitive material in a substantially U-shape in the tanks.

Holding rollers 30 for conveying the photosensitive material 14 into the developing tank 16 and holding rollers 32 for conveying the photosensitive material 14 treated by development processing to the fixation bleaching tank 18 are provided above the developing tank 16.

Moreover, holding rollers 34 for conveying the photosensitive material 14 from the developing tank 16 to the fixation bleaching tank 18, and holding rollers 36 for conveying the photosensitive material 14 treated fixation processing to the first water washing tank 20 are provided above the fixation bleaching tank 18.

Further, holding rollers 38 for conveying the photosensitive material 14 treated by fixation processing into the first water washing tank 20 are provided above the first water washing tank 20.

A photosensitive material path member 46, capable of allowing passage of the photosensitive material 14 as well as preventing passage of solution is provided in a partition wall 40 between the first water washing tank 20 and the second water washing tank 22, in a partition wall 42 between the second water washing tank 22 and the third water washing tank 24, and in a partition wall 44 between the third water washing tank 24 and the fourth water washing tank 26.

Moreover, nip rollers 50 are provided, as a conveyance device for conveying the photosensitive material 14, in each of the first water washing tank 20, the second water washing tank 22, the third water washing tank 24, and the fourth water washing tank 26.

Holding roller 52*s* for conveying the photosensitive material 14 washed with water to an unillustrated drying processing section are provided above the fourth water washing tank 26.

Moreover, the end part of a pipe 56 for supplying a fresh water washing processing solution stored in a replenishing tank 54 to the fourth water washing tank 26 is provided above the fourth water washing tank 26. Furthermore, a pump 58 for supplying water washing processing solution stored in a replenishing tank 54 to the fourth water washing tank 26 is provided at the pipe 56.

The pump 58 is connected to a pump driving device 60 for driving the pump at a predetermined timing.

Moreover, an overflow pipe 62 for discharging water washing processing solution exceeding the predetermined amount is provided in the first water washing tank 20, whereby the overflowed water washing processing solution is stored in a storage tank 64 via the overflow pipe 62.

Next, the structure of the photosensitive material path member 46 will be explained in detail.

Figure 3:
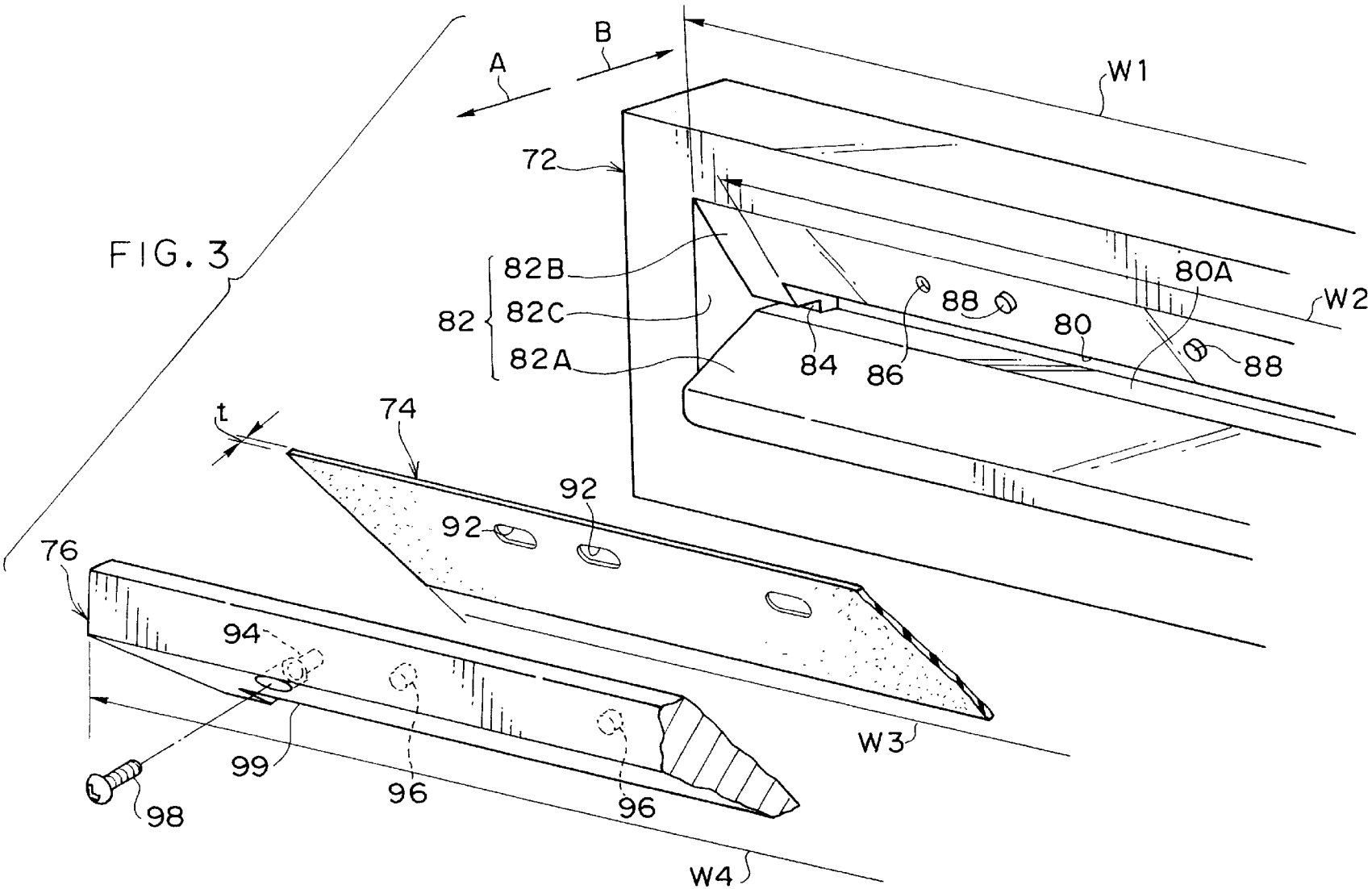
FIG. 3 is an exploded perspective view of the photosensitive material path member of the present invention.

As shown in FIGS. 1 and 3, the photosensitive material path member 46 comprises a main body 72, a blade 74, and a blade press 76 that are detachably disposed at an opening 70 of the partition wall 40 (the same is true of path member 46 with respect to the other partition walls 42 and 44).

The main body 72 is mounted on the partition wall 40 by screws 77. A packing 79 comprising an elastic sheet such as rubber or the like is disposed between the main body 72 and the partition wall 40.

In the present embodiment, the main body 72 is formed of a synthetic resin (for example, PC, PPE, ABS, and PPS) containing glass fiber,;and includes a photosensitive material conveyance path 78 for allowing passage of the photosensitive material 14.

The photosensitive material conveyance path 78 includes a slit hole 80 having a fixed width hi formed lengthwise along the width direction of the photosensitive material 14 (i.e., the direction orthogonal to direction in which the photosensitive material is conveyed) and an insertion part 82 provided at the upstream side with respect to the slit hole 80, with the width of the insertion part 82 in the vertical direction gradually widening toward the upstream side.

Each of a lower wall surface 80A and an upper wall surface 80B of the slit hole 80 are formed horizontally.

In the present embodiment, the photosensitive material 14 is conveyed horizontally between the water washing tanks.

Figure 4:
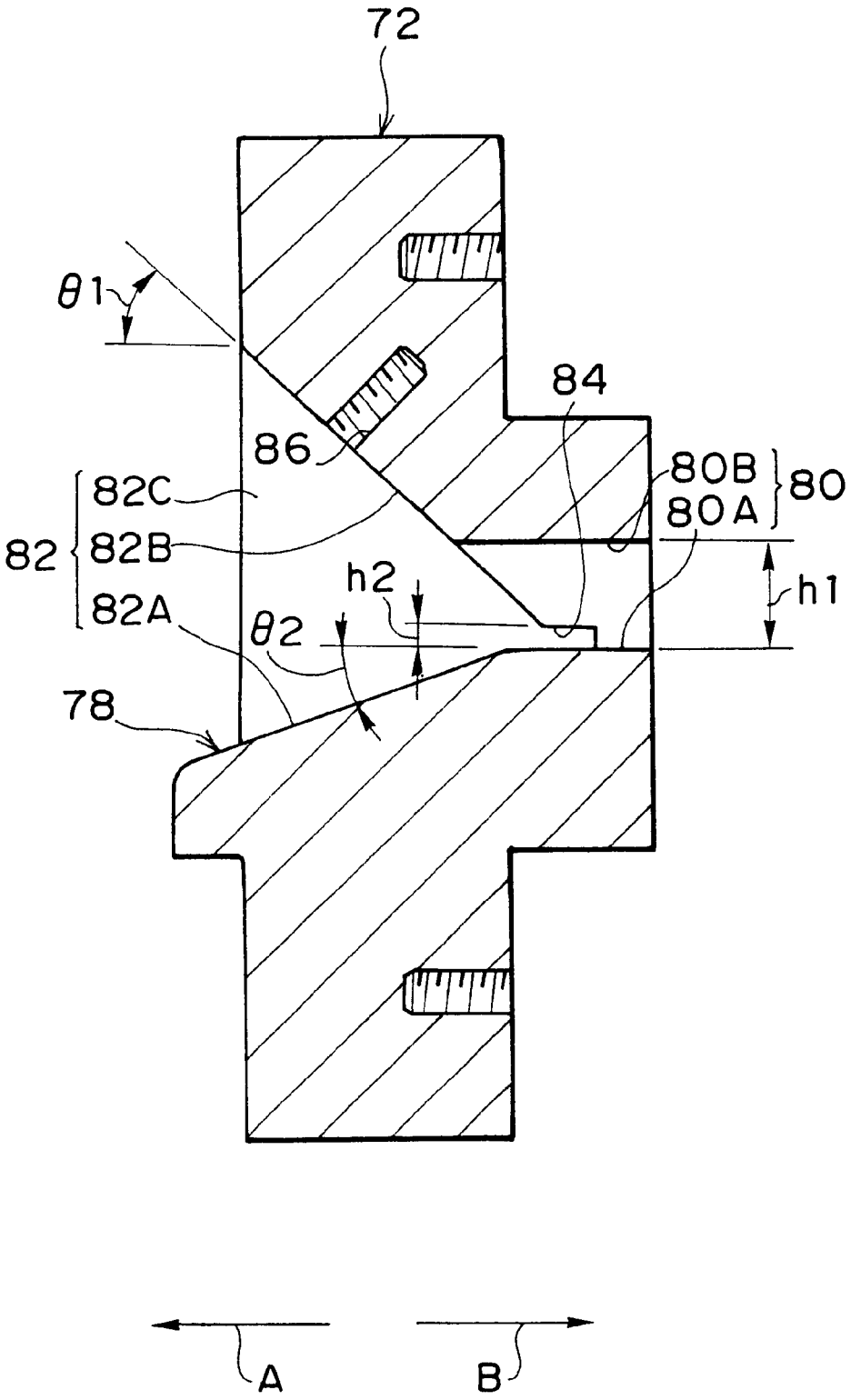
FIG. 4 is an enlarged cross-sectional view of a main body of the present invention.

As shown in FIG. 4, an upper wall surface 82B of the insertion part 82 is tilted by an angle θ1 with respect to the conveyance surface (horizontal) of the photosensitive material 14, and a lower wall surface 82A of the insertion part 82 is tilted by an angle θ2 with respect to the conveyance surface (horizontal) of the photosensitive material 14.

The angle θ1 and the angle θ2 are preferably in a range of 10° to 80°, and more preferably in a range of 10° to 30°.

As shown in FIGS. 3 and 4, the slit hole 80 opens to the upper wall surface 82B of the insertion part 82.

As shown in FIG. 3, a dimension W1 of the insertion part 82 (the upper wall surface 82B, the lower wall surface 82A) in the longitudinal direction is set to be larger than a dimension W2 of the slit hole 80 in the longitudinal direction.

As shown in FIGS. 3 and 4, a groove 84 is formed along the lower wall surface 80A of the slit hole 80 in the vicinity of both ends in the longitudinal direction of the insertion part 82, from the portion at which the upper wall surface 82B and the lower wall surface 82A intersect toward the downstream side of the direction of conveyance (i.e., the direction of arrow B).

As shown in FIG. 4, a width h2 of the groove 84 is set to be slightly larger than a thickness t of a blade 74 described later (thicker than the blade thickness by about 0.01 to 0.5 mm). The thickness t of the blade 74 in this embodiment is 0.5 mm, but it is preferably about 0.3 to 0.7 mm.

The reason the width h2 of the groove 84 is made slightly larger than the thickness t of the blade 74 is to move the blade 74 with respect to the groove 84 so that waves, wrinkles or the like are prevented from arising in the blade 74 in the event that there is a difference between a change in the size of the blade 74 due thermal expansion and a change in the size of the photosensitive material path member 46 due to thermal expansion. It is preferable that the difference between the width h2 of the groove 84 and the thickness t of the blade 74 is as small as possible within a range in which relative movement of the blade 74 is allowed.

As shown in FIGS. 3 and 4, a plurality of screw holes 86 and columnar projections 88 are formed in the upper wall surface 82B along the longitudinal direction.

The blade 74 mounted on the upper wall surface 82B comprises a thin sheet-like elastic member formed in a rectangular shape having a fixed thickness. In the present embodiment, the blade 74 is made of a urethane resin. However, the blade may be made of another material such as rubber as long as the material has elasticity. Preferred materials for the blade 74 are given below.

A polyurethane resin having a hardness of JIS A, 80° to 99°, is preferable for the blade 74. In particular, a thermosetting polyurethane material having a polyether-based prepolymer as the material is preferable for the material of the blade 74 that is to be used in a solution over a long period of time.

Examples of the material polyisocyanate include TDI (trilene diisocyanate) and a TDI-based prepolymer. A PTMG-based (polytetramethylene ether glycol based) material is particularly preferable as the polyether-based prepolymer. An aromatic amine based compound is used as a curing material.

Specific examples include Coronate 4080, Coronate 4090, Coronate 4095, Coronate 4099, Coronate 6912 and the like, produced by Nihon Polyurethane Kogyo Corp. These materials are TDI-based polyurethanes and PTMG-based prepolymers. Other specific examples include Takenate L-2000 series, L-2690, L-2695, L-2705, L-2710, L-2760, or the like, produced by Takeda Yakuhin Kogyo Corp. These materials are PTMG-based mold pouring type polyurethane resins.

Although specific examples of preferred materials have been presented, the present invention is not limited to the same. The series of substances that are thermosetting urethane elastomers disclosed on p. 116 of "Latest Polyurethane Application Technology" (published by CMC, Feb. 26, 1983) and that are referred to as adiplene type prepolymers (PTG(polyether polyols)/TDI type) among the prepolyer mold pouring type urethane elastomers disclosed on p. 117 can be applied.

As shown in FIG. 3, the dimension W1 of the insertion part 82 (the upper wall surface 82B, the lower wall surface 82A) in the longitudinal direction is set to be slightly larger (0.1 to 1.5 mm) than the dimension W3 of the blade 74 in the longitudinal direction.

The reason for this is because the coefficient of thermal expansion of the blade 74 is larger than the coefficient of thermal expansion of the main body 72 in this embodiment, and is to prevent distortion (waves, wrinkles or the like) of the blade 74 due to both ends of the blade 74 coming into strong contact with the side walls 82C at both sides of the insertion part 82 in the longitudinal direction caused by thermal expansion of the blade 74.

In the blade 74, long holes 92 are formed at positions that are opposite screw holes 86 formed in the upper wall surface 82B and that face the projections 88. The long holes 92 are formed lengthwise along the longitudinal direction of the blade 74.

The blade press 76 is made of the same material as that of the main body 72 and is formed lengthwise along the longitudinal direction of the photosensitive material conveyance path 78. Moreover, the blade press 76 has a substantially triangular cross-sectional shape in the direction perpendicular to the photosensitive material conveyance path 78 longitudinal direction as shown in FIG. 1. The dimension W4 of the blade press 76 in the longitudinal direction is the same size as the blade 76 longitudinal direction dimension W3 (or a size slightly smaller than W1).

The blade press 76 is provided with a screw inserting hole 94 formed at a position facing a screw hole 86 of the upper wall surface 82B, and round holes 96 formed for fitting the projections 88 therein are formed on the mounting surface facing the upper wall surface 82B.

Figure 1C:
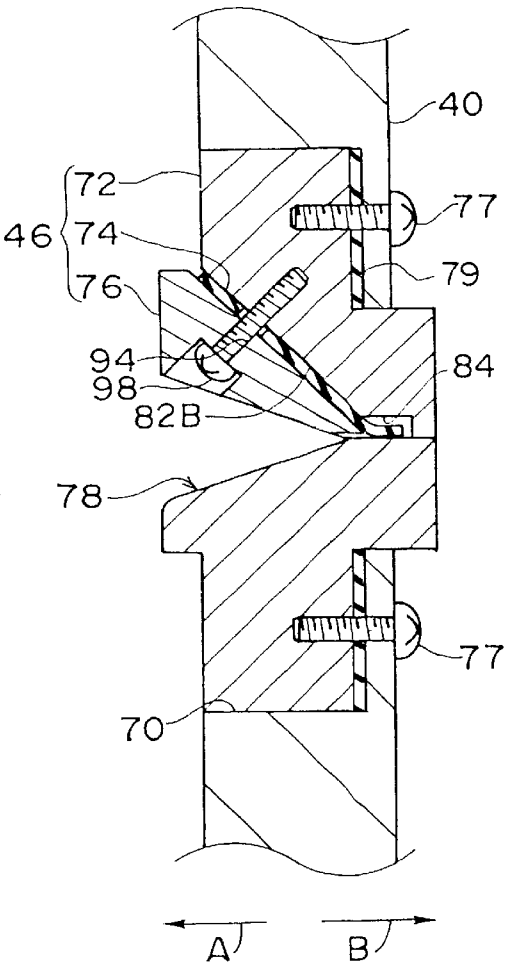
FIG. 1C is an enlarged cross-sectional view of the vicinity of a groove in the photosensitive material path member of the present invention.
Figure 1B:
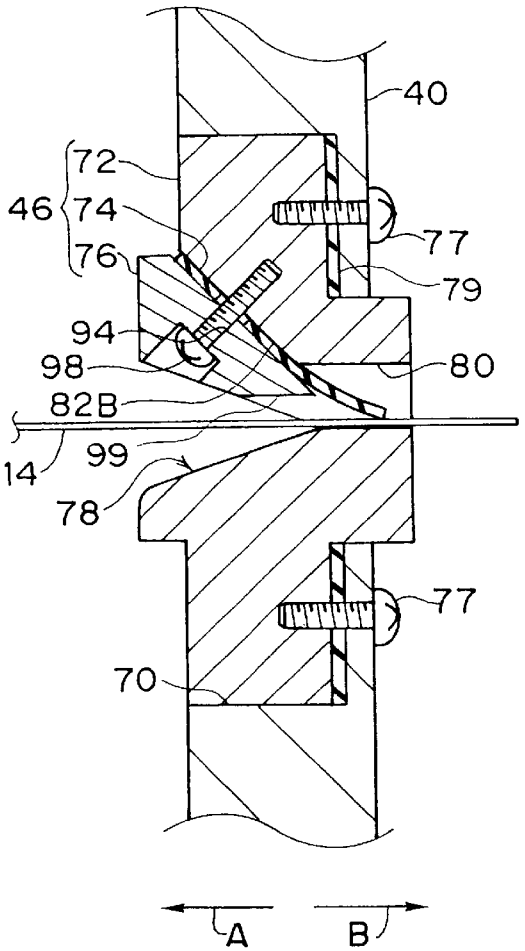
FIG. 1B is an enlarged cross-sectional view of the vicinity of the photosensitive material path member of the present invention during passage of the photosensitive material.
Figure 1A:
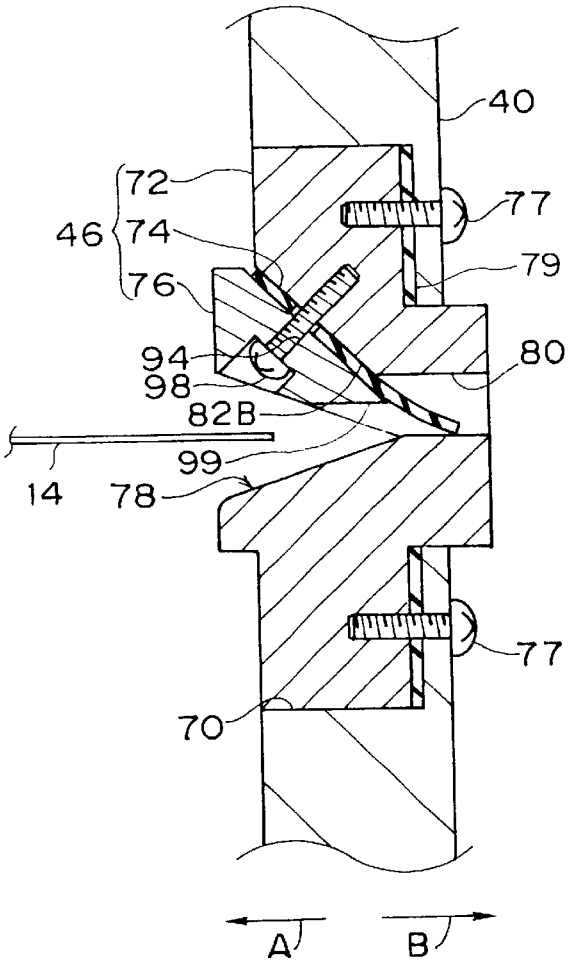
FIG. 1A is an enlarged cross-sectional view of the vicinity of a photosensitive material path member of the present invention before passage of the photosensitive material.

As shown in FIGS. 1A–1C, the blade 74 is held between the upper wall surface 82B and the blade press 76 by inserting the screw 98 into the screw inserting hole 94 formed in the blade press 76 and then screwing the screw 98 into the screw hole 86 formed in the upper wall surface 82B.

Figure 5:
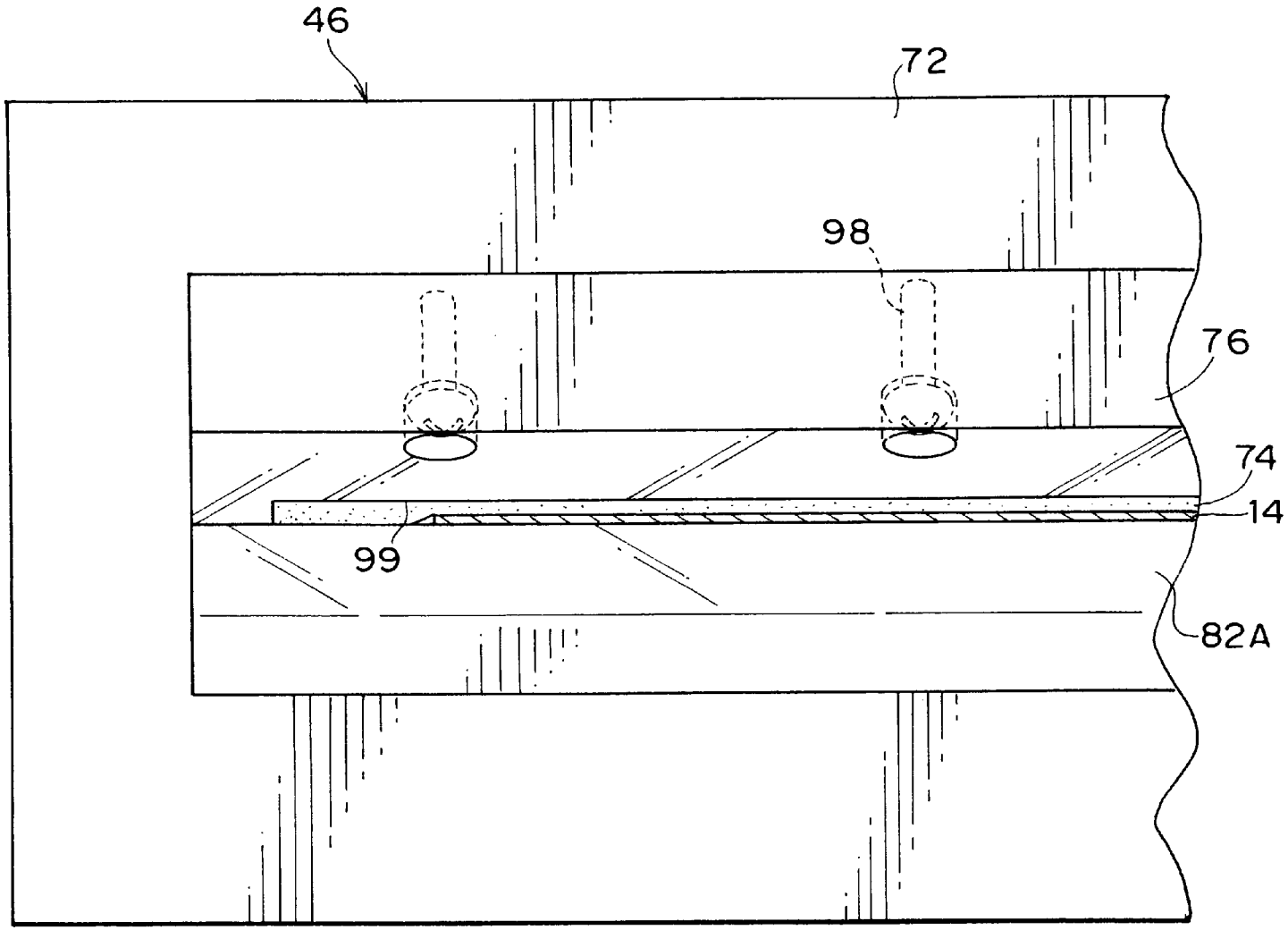
FIG. 5 is a front view of the photosensitive material path member of the present invention during passage of the photosensitive material.

As shown in FIGS. 1A, 3 and 5, the blade press 76 is provided with a notch 99 formed at a position facing the slit hole 80.

The blade 74 is fixed in a state in which the upper end edge thereof extending along the longitudinal direction and the vicinity of the end edge at both sides in the longitudinal direction closely contact the upper wall surface 82B.

The blade 74 is held in a state in which the vicinity of the lower end edge is pressed against the lower wall surface 82A of the slit hole 80 along the entire length and the vicinity of both ends (corner parts) of the blade 74 is inserted in the groove 84 as shown in FIG. 1C.

The blade 74 is fixed between the main body 72 and the blade press 76 by such a holding force that it can be moved relatively with respect to the main body 72 and the blade press 76 at the time of thermal expansion.

Next, the effect of this embodiment will be described.

At the automatic developing device 10, the photosensitive material 14 is immersed in developing solution in the developing tank 16, and then immersed in fixing solution in the fixation bleaching tank 18 and conveyed to the first water washing tank 20. In this embodiment, the photosensitive material 14 is conveyed with the emulsion surface thereof as the upper side and the support as the lower side.

The photosensitive material 14 sent to the first water washing tank 20 is washed with washing water stored in the first water washing tank 20.

The photosensitive material 14 washed with water in the first water washing tank 20 is conveyed to the second water washing tank 22 by the nip rollers 50. The photosensitive material 14 is conveyed to the second water washing tank 22 by deforming the blade 74 of the photosensitive material path member 46 to pass between the blade 74 and the lower wall surface 80A of the slit hole 80 while being slid. After passage of the photosensitive material 14, the lower end edge of the blade 74 is pressed and closely contacted again with the lower wall surface 80A of the slit hole 80 so as to prohibit passage of solution.

Thereafter, the photosensitive material 14 similarly passes through each photosensitive material path member 46 to be washed with washing water in each of the second water washing tank 22, the third water washing tank 24, and the fourth water washing tank 26. The photosensitive material 14 is then conveyed to the drying processing section by the holding roller pair 52.

In the automatic developing device 10 of the present embodiment, washing water is replenished by the so-called cascade method. For example, fresh washing water is replenished to the fourth water washing tank 26, according to the amount of the photosensitive material 14 processed, at the most downstream side of the photosensitive material 14 conveyance direction.

Moreover, the submerged conveyance structure of the automatic developing device 10 of the present embodiment has the following excellent effects.

(1) Since the photosensitive material path member 46 according to this embodiment comprises three parts, i.e., the main body 72, the blade 74 and the blade press 76, the number of parts is small so that assembly thereof is facilitated.

(2) Since the blade 74 can be replaced by removing the photosensitive material path member 46 to the outside of the tank, replacement of the blade 74 is facilitated.

(3) Since the blade 74 is fixed relatively movably with respect to the main body 72 and the blade press 76, distortion (waves, wrinkles or the like) is not generated in the blade 74 even when the coefficients of linear expansion of the blade 74 and the main body 72 are different or even if there are changes in temperature. Moreover, since the lower edge end of the blade 74 is always reliably pressed by the lower wall surface 80A of the slit hole 80, there is no deterioration in the sealing property of the blade 74.

(4) Since the main body 72 and the blade press 76 are made of a synthetic resin containing a glass fiber, amount of thermal distortion can be reduced whereby the source responsible for generating distortions in the blade 76 can be reduced.

Other Embodiments

Although the main body 72 and the blade press 76 are made of a synthetic resin in the preceding embodiment, a material having a friction coefficient lower (solid lubricating agent) than that of the synthetic resin comprising the main body 72 and the blade press 76 may be coated (or adhered) on the portion to be contacted and slid upon by the photosensitive material 14.

Moreover, with respect to the blade 74, a material having a friction coefficient lower than that of the material comprising the blade 74 can be coated on the portion to be contacted and slid upon by the photosensitive material 14.

Examples of such material having a low friction coefficient include fluorine resins, molybdenum disulfide and the like, but other materials may be used as well.

By providing a material having a low friction coefficient at the portion to be contacted and slid upon by the photosensitive material 14, wear can be suppressed so that the sealing property can be maintained over a long time and the photosensitive material 14 can be conveyed while being slid smoothly.

In the preceding embodiment, the blade press 76 is fastened on the main body 72 by being screwed. However, the blade press 76 and the main body 72 can also be fixed using a snap-type fastener, wherein one member having a convex projection formed thereon is fitted together with another member having a concavity formed therein by inserting the convex projection into the cavity.

Further, in the preceding embodiment, the main body 72 is fixed to the partition walls 40, 42, 44 by being screwed, so that the main body 72 may be detached from the partition walls 40, 42, 44. However, the main body 72 may also be provided integrally with the partition wall 40, 42, 44, i.e., the photosensitive material conveyance path 78 can be formed directly in the partition walls 40, 42, 44, whereby the number of parts can further be reduced.

Still further, in the preceding embodiment, the photosensitive material path member 46 is used in the partition walls 40, 42, 44 between the water washing tanks in the above-mentioned embodiment. However, the photosensitive material path member 46 can be used for a partition wall between other processing tanks.

As heretofore explained, according to the submerged conveyance structure for photosensitive material of the present invention, leakage of solution between the processing tanks can be reliably prevented with a small number of parts and sealing property can be maintained over a long period of time. Furthermore, the present invention has the excellent effect of conveying a photosensitive material while sliding the same smoothly.

What is claimed is:

1. A submerged conveyance structure for photosensitive material, the structure comprising:

a main body, the main body including a photosensitive material conveyance path for passage of a photosensitive material, the photosensitive material conveyance path formed in partition walls between processing tanks in which processing solutions are stored;

a sheet-like blade, the blade disposed in the photosensitive material conveyance path and having an elasticity capable of allowing passage of the photosensitive material with respect to the photosensitive material conveyance path while preventing passage of the processing solutions; and a mounting member for mounting the blade to the photosensitive material conveyance path;

wherein the photosensitive material conveyance path has a first tilted surface provided at the upstream side of the direction in which the photosensitive material is conveyed, the first tilted surface facing one surface of the photosensitive material and tilted by an acute angle toward the upstream side of the direction in which the photosensitive material is conveyed, with respect to a photosensitive material passage route, a second tilted surface provided at the upstream side of the direction in which the photosensitive material is conveyed, the second tilted surface facing the other surface of the photosensitive material and tilted by an acute angle toward the upstream side of the direction in which the photosensitive material is conveyed, with respect to the photosensitive material passage route, and a slit hole provided at the downstream side of the direction in which the photosensitive material is conveyed, the slit hole opening toward one of the first tilted surface and the second tilted surface, the slit hole being formed lengthwise in a direction orthogonal to the direction in which the photosensitive material is conveyed, and the blade covers the slit hole in a state in which an end edge extending in the longitudinal direction at the side facing the slit hole elastically contacts one of a path upper wall surface and a path lower wall surface of the photosensitive material conveyance path, and a vicinity of the end edges of both sides in the longitudinal direction and a vicinity of the end edge on the opposite side with respect to the side elastically contacting either one of the path upper wall surface and the path lower wall surface are nipped by the mounting member and at least one of the first tilted surface or the second tilted surface having the slit hole.

2. The submerged conveyance structure for photosensitive material of claim 1, wherein longitudinal direction side portions of the end edge of the blade, which end edge elastically contacts the path wall surface, are inserted in a groove formed at an area where the first tilted surface and the second tilted surface intersect.

3. The submerged conveyance structure for photosensitive material of claim 2, wherein the blade is held relatively movably between the main body and the mounting member.

4. The submerged conveyance structure for photosensitive material of claim 3, wherein a dimension of the mounting member in the longitudinal direction is set to be substantially the same as a dimension of the blade in the longitudinal direction.

5. The submerged conveyance structure for photosensitive material of claim 3, wherein a mounting surface nearest the photosensitive material conveyance path and opposite to a blade nipping surface of the mounting member is a conveyance surface.

6. The submerged conveyance structure for photosensitive material of claim 3, wherein the main body, the blade part and the mounting part are detachable.

7. The submerged conveyance structure for photosensitive material of claim 3, wherein the first tilted surface and the second tilted surface are tilted with respect to the photosensitive material passage route in a range of 10° to 80°.

8. The submerged conveyance structure for photosensitive material of claim 3, wherein the dimension of the first tilted surface in the longitudinal direction and the dimension of the second tilted surface in the longitudinal direction are greater than the dimension of the slit hole in the longitudinal direction.

9. The submerged conveyance structure for photosensitive material of claim 3, wherein the dimension of the first tilted surface in the longitudinal direction and the dimension of the second tilted surface in the longitudinal direction are greater than the dimension of the blade in the longitudinal direction.

10. The submerged conveyance structure for photosensitive material of claim 3, wherein the blade comprises a polyurethane resin.

11. The submerged conveyance structure for photosensitive material of claim 10, wherein the blade has a hardness of 80° to 99°.

12. The submerged conveyance structure for. photosensitive material of claim 2, wherein the groove includes a width greater than blade thickness.

13. The submerged conveyance structure for photosensitive material of claim 12, wherein the blade comprises a substantially rectangular shape with a fixed thickness.

14. The submerged conveyance structure for photosensitive material of claim 13, wherein the blade thickness is in a range of 0.3 to 0.7 mm.

15. The submerged conveyance structure for photosensitive material of claim 1, wherein the blade is held relatively movably between the main body and the mounting member.

16. The submerged conveyance structure for photosensitive material of claim 1, wherein the main body and the mounting member comprise a synthetic resin including glass fiber.

17. The submerged conveyance structure for photosensitive material of claim 1, wherein areas of the main body and the mounting member contacting the photosensitive material are disposed with a low frictional material having a friction coefficient lower than that of the material comprising the main body and the mounting member.

18. The submerged-conveyance structure for photosensitive material of claim 1, wherein one of the first tilted surface and the second tilted surface includes screw holes and projections along the longitudinal direction.

19. The submerged conveyance structure for photosensitive material of claim 18, wherein the mounting member includes a screw hole and a fitting hole at positions corresponding to each of the screw holes and the projections.

20. The submerged conveyance structure for photosensitive material of claim 18, wherein the blade includes circular or elongated holes at a position corresponding to the screw holes sand the projections.

* * * * *